US005620301A

United States Patent [19]

Lawer

[11] Patent Number: 5,620,301

[45] Date of Patent: Apr. 15, 1997

[54] ACTUATOR MECHANISM FOR VARIABLE ANGLE VANE ARRAYS

[75] Inventor: Steven D. Lawer, Derby, England

[73] Assignee: Rolls-Royce plc, England

[21] Appl. No.: 628,156

[22] Filed: Apr. 5, 1996

[30] Foreign Application Priority Data

Jun. 5, 1995 [GB] United Kingdom ..... 9511271

[51] Int. Cl.[6] ..... F01D 17/12

[52] U.S. Cl. ..... 415/150; 74/109

[58] Field of Search ..... 415/150, 159, 415/160, 162; 74/109

[56] References Cited

U.S. PATENT DOCUMENTS

| | | | |
|---|---|---|---|
| 4,258,580 | 3/1981 | Lowe | 74/109 |
| 4,530,252 | 7/1985 | Sarges et al. | 74/109 |

FOREIGN PATENT DOCUMENTS

| | | |
|---|---|---|
| 1604089 | 4/1967 | United Kingdom . |
| 1324385 | 7/1973 | United Kingdom . |
| 1466613 | 3/1977 | United Kingdom . |
| 1492390 | 11/1977 | United Kingdom . |

*Primary Examiner*—John T. Kwon
*Attorney, Agent, or Firm*—Cushman Darby & Cushman IP Group of Pillsbury Madison & Sutro LLP

[57] ABSTRACT

A power turbine includes a stage of pivotable nozzle vanes. The individual vanes are pivoted by connecting them to a toothed unison ring via actuating levers in the form of gear segments. The gear segments only have sufficient teeth to enable pivoting of the vanes between normal maximum and minimum operating angles. If an emergency closure of the nozzle is required, the unison ring pivots the gear therewith, whereupon pins on the unison ring engage projections on each segment, thus causing the segments to continue pivoting the vanes to a closed position.

11 Claims, 1 Drawing Sheet

ACTUATOR MECHANISM FOR VARIABLE ANGLE VANE ARRAYS

BACKGROUND OF THE INVENTION

1. Field of the Invention

The present invention concerns variable angle vane arrays in axial fluid flow machines. It is particularly, but not exclusively, concerned with variable area nozzle vane arrays suitable for use in power turbines forming part of gas turbine engines of the kind utilised in industrial and marine environments, for example the propulsion of ships.

2. Description of the Prior Art

Due to the need to optimise performance of power turbines in gas turbine engines, a nozzle vane array which directs a working fluid onto a power turbine should have the capability of varying the its nozzle area. This can be achieved by pivoting the vanes in unison about axes extending radially of the turbine, so varying the vanes' angle with respect to the flow of fluid therepast. By this means, the total throat area of the nozzle can be varied between maximum and minimum scheduled values during normal operation of the engine.

In mechanisms for achieving pivoting of the vanes, it is usual to connect each vane via respective levers to a common actuating or unison ring surrounding the turbine casing, so that when the ring is rotated about the turbine axis, the vanes pivot in unison to either increase or decrease the nozzle throat area.

In one known type of mechanism, the lever arms comprise gear segments, one end of the lever arm including the gear circle centre, which is fixed to a respective vane, the other end comprising the toothed rim of the gear segment. The gear segment teeth mesh with a toothed unison ring to enable simultaneous pivoting of the vanes.

In an emergency, such as turbine shaft breakage, leading to overspeed of the power turbine, it is highly desirable to have the capability of effecting substantially total obturation (ie shut-down of the nozzle. This action substantially prevents the working fluid impinging on the turbine rotor blades, thereby avoiding freewheeling runaway of the rotating parts of the turbine with consequent severe damage.

Vane actuating levers in the form of gear segments have a drawback, in that if the number of vanes in the array is such that they are closely spaced around the circumference of the turbine casing, the gear segments cannot be made large enough to remain in toothed engagement with the ring while pivoting sufficiently to substantially close the throat of the stage, without interfering or overlapping with each other.

SUMMARY OF THE INVENTION

The present invention seeks to provide an improved variable angle vane actuator mechanism.

According to the present invention, an actuator mechanism for a variable angle vane array, the vanes being pivotable between positions giving maximum and minimum fluid flow delivery, comprises;

a lever arm in the form of a gear segment secured to a radially outer end of each vane for effecting pivoting movement thereof, a toothed unison ring meshing with the gear segments for simultaneous transmission of pivoting movement to each vane through their respective gear segments, and wherein;

the gear segments and the unison ring are provided with emergency drive means which engage to cause the gear segments to turn beyond toothed engagement with the unison ring so as to pivot their respective vanes to an effective zero fluid delivery position.

If, during operation of the power turbine, overspeed or potential overspeed of the turbine rotor is detected by the gas turbine engine's control system, it commands the variable angle nozzle vane array to "slam-shut" to prevent runaway acceleration of the turbine. If a slam-shut is required, in our preferred embodiment the unison ring drives the gear segments until the last tooth at the end of the segment is engaged by the unison ring. From this point, further drive of each gear segment to the fully closed position of the vanes is achieved by a projection from the unison ring contacting a projection from a surface of the gear segment, without drive being transmitted through the gear teeth.

To prevent collision of the leading and trailing edges of adjacent aerofoils when a slam-shut is commanded, the toothed rim of each gear segment may be provided with an abutment surface at its end which contacts a further abutment surface on a side of the adjacent gear segment just before full closure occurs.

In this way, the variable nozzle can be shut in emergencies without compromising the design of the drive mechanism for normal operation.

BRIEF DESCRIPTION OF THE DRAWINGS

The invention will now be described, by way of example and with reference to the accompanying drawings in which.

DETAILED DESCRIPTION OF THE INVENTION

Figure 1:
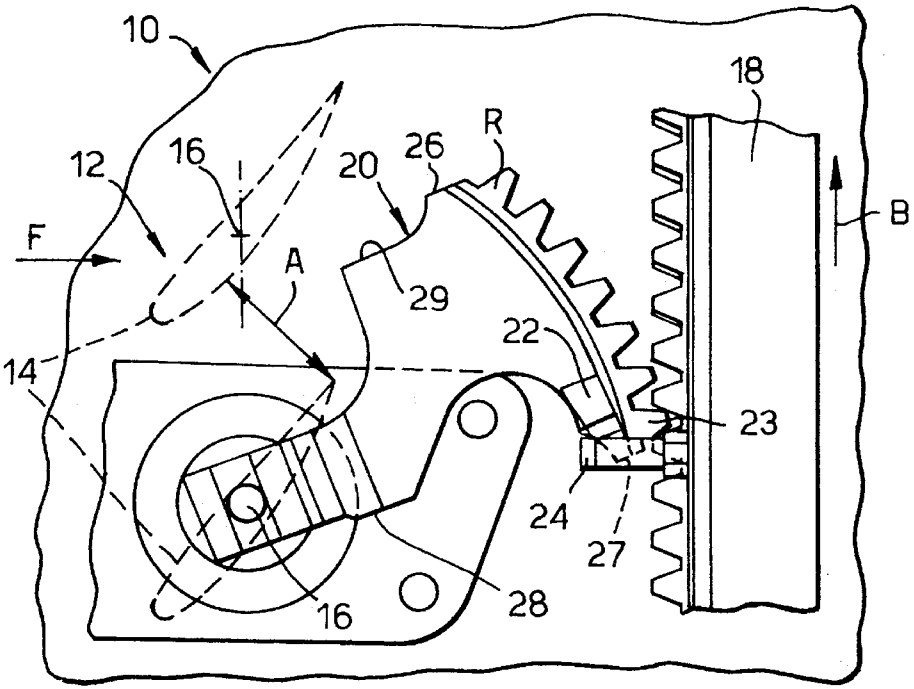
FIG. 1 is a plan view of an actuator mechanism in accordance with the present invention, in position on the exterior of a casing containing a stage of variable nozzle vanes.

Referring to FIG. 1, a turbine casing 10 is part of a gas turbine engine and contains a stage of pivotable nozzle vanes 12. Only a small part of the casing 10 is shown, it being a well known structure in the turbine field. Only two vanes 14 of the complete array are shown for convenience.

Each vane 14 is pivotable about a respective axis 16 which projects approximately radially inwardly of the casing 10. All of the vanes 14 in the stage 12 are caused to simultaneously pivot in the same direction on command from a gas turbine engine control system (not shown), by being driven from a toothed unison ring 18 actuated by hydraulic rams or other actuators (not shown). Drive from the unison ring 18 to each vane 14 is through a respective lever arm in the form of a gear segment 20, only one of these being shown in FIG. 1. By engagement of the toothed unison ring 18 with the toothed rim R of each gear segment, the angle or the vanes with respect to the overall direction of fluid flow 'F' through the turbine can be varied to vary the power extracted from the turbine gases by the turbine.

In FIG. 1, dimension 'A' represents the distance between neighbouring vanes 14 at the throat of the variable area nozzle they define between them. At the illustrated angle of the vanes, the nozzle throat area is a little less than the absolute minimum required during normal operation of the power turbine, eg, say about 30% of the possible maximum throat area. Consequently, the power being produced by the turbine will also be less than the absolute minimum required during normal operation. It will be noticed that, when the vanes 14 are driven to this position by rotation of the unison ring 18 in the direction of arrow 'B', the toothed rim R of gear segment 20 is at its limit of toothed engagement with the actuation ring 18, as are all of the other gear segments (not shown). On the other hand, maximum power is obtained from the turbine when the unison ring 18 is driven in the direction opposed to arrow 'B' until the vanes 14 are aligned with arrow 'F' and dimension 'A' is at a maximum, ie the nozzle is fully open, the throat area being 100% of the possible maximum and the toothed rim R of gear segment 20 is at an opposite limit of toothed engagement with the actuation ring.

Operational safety of the power turbine demands that precautions be taken in the unlikely event of a runaway overspeed of the power turbine rotor, occasioned, for example by breakage of the shaft upon which the turbine rotor is mounted and consequent freeing of the turbine rotor from connection to any restraining load, such as propulsive machinery or a generator. An adequate precaution is to effectively close the throat of the vane array 14 as quickly as possible. This substantially prevents impingement of the turbine gases on the rotor blades and is termed a "slam shut" operation.

Clearly, the arc over which the gear segment 20 can be moved by toothed engagement with the unison ring 18 is insufficient to effectively close the throat of vane array 14. Therefore, further features are provided to drive the gear segments 20 beyond the limit of toothed engagement with the unison ring 18. In the present example, these features are an abutment or projecting tab 22 on the extremity of the upper surface of the toothed rim R of each gear segment 20, and one pin 24 for each gear segment 20, the pins being fixed in the unison ring 18 at equiangularly spaced intervals around it.

Figure 2:
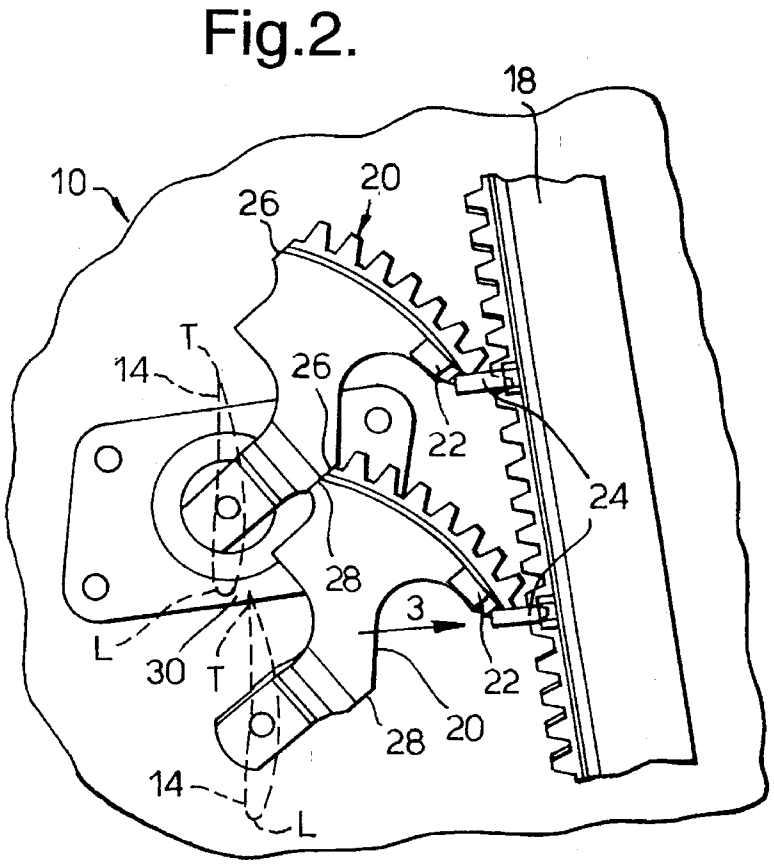
FIG. 2 shows a view similar to FIG. 1 but using a smaller scale, with the actuator mechanism in a different operating position.
Figure 3:
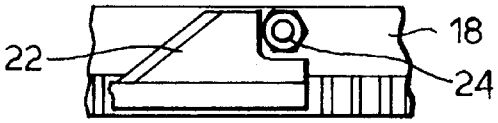
FIG. 3 is a part view in the direction of arrow 3 in FIG. 2.

If a slam-shut is required, the unison ring 18 drives the gear segments until the last tooth 23 at the end of the toothed rim R of segment 20 is engaged by the unison ring. From this point, as best seen in FIGS. 2 and 3, further drive of each gear segment 20 to the fully closed position of the vanes 14 is achieved by the projecting peg 24 on unison ring 18 contacting the projection 22 from the toothed rim R of the gear segment 20, without drive being transmitted through the gear teeth. It will be seen that this emergency drive arrangement removes the need to increase the circumferential extent of the toothed rims R of segments 20 for the purpose of including further teeth.

Referring now to FIG. 2, it is important that "slam shut" closure must not cause the leading and trailing edges L,T of the fluid-deflecting aerofoil sections of adjacent vanes 14 to collide with each other. If this should occur, the vanes 14 would likely be damaged. The present invention avoids such collision by providing each gear segment with abutments which provide a limit to their angular movements. In the present example, an abutment 26 is provided at the leading end of the toothed rim R of each segment 20, as defined when the vanes 14 are pivoting towards the throat closed position. The limit of movement of the gear segments is imposed when abutment 26 on each segment contacts a further abutment 28 on the confronting side of each adjacent segment. This results in the ring of segments 20 jamming in a position in which the leading and trailing edges L,T of adjacent vanes 14 are in very close, but not touching, proximity, gaps 30 being left which are too small to allow sufficient gas through to provide drive to the associated turbine rotor (not shown).

The invention described and claimed in the applicants British Patent Application number 9511269.4, filed on 5 Jun. 1995, entitled "Variable Angle Vane Arrays", is typical of the kind of structure to which the present invention is applicable. The disclosure therein should therefore be regarded as included in this specification. In particular, with respect to the mechanism described above, the gear segments 20 include further abutments 27,29 (FIG. 1). These are so positioned with respect to each other and the teeth of their respective gear segments, as to ensure correct engagement of the gear segments with the unison ring 18—and thereby correct positioning of the vanes—when the vanes with their attached gear segments are assembled into the power turbine structure at an extremity of operational movement of the vanes, preferably when the nozzle they form is in the fully open position.

I claim:

1. An actuator mechanism for a variable angle vane array for use in a fluid flow machine of the type having an axis and a casing, the variable angle vane array comprising a plurality of vanes, the vanes are pivotably mounted in the casing about radial axes, the vanes are pivotable between a first position giving maximum fluid flow delivery, and a second position giving minimum fluid flow delivery, each vane having a radially outer end, the mechanism comprising a lever arm in the form of a gear segment secured to the radially outer end of each vane for effecting pivoting movement thereof, and a toothed unison ring meshing with the gear segments for simultaneous transmission of pivoting movement to each vane through their respective gear segments, wherein, the gear segments and the unison ring are provided with emergency drive means which engage to cause the gear segments to turn beyond toothed engagement with the unison ring so as to pivot their respective vanes to an effective zero fluid delivery position.

2. The mechanism of claim 1, wherein the emergency drive means comprises a first projection from each gear segment and corresponding second projections on the unison ring, said first and second projections being positioned so as to simultaneously engage, one first projection with each second projection, when the gear segments reach a limit of toothed engagement with the unison ring, thereby to cause further pivoting of the gear segments to the effective zero fluid delivery position.

3. The mechanism of claim 2, wherein the gear segments include abutment features positioned to engage each other just as the vanes reach the effective zero fluid delivery position, thereby to prevent fluid deflecting portions of the vanes contacting each other.

4. The mechanism of claim 1, wherein the gear segments include further abutments which are so positioned with respect to each other and the teeth of their respective gear segments as to ensure correct engagement of the gear segments with the unison ring when the vanes with their attached gear segments are assembled into the fluid flow machine at an extremity of operational movement of the vanes.

5. The mechanism of claim 1, wherein each gear segment has a first projection and each unison ring has second projections and the first projection from each gear segment extends radially from the gear segment and the second projections on the unison ring extend axially from the unison ring.

6. The mechanism of claim 5, wherein the first projection from each gear segment extends radially outwardly from the gear segment.

7. The mechanism of claim 1, wherein the variable angle vane array is in a turbine.

8. The mechanism of claim 1, wherein the variable angle vane array is in a power turbine.

9. The mechanism of claim 1, wherein the variable angle vane array is in a gas turbine engine.

10. A variable angle vane having first and second ends and an axis of rotation extending longitudinally of the vane, the vane having a lever arm in the form of a gear segment secured to, and extending substantially perpendicular from the first end of the vane, the gear segment having first and second extremities, the lever arm having a projection extending substantially longitudinally, relative to the vane, from the lever arm, the projection being located at the first extremity of the gear segment.

11. A variable angle vane as claimed in claim 10, wherein the projection extends away from the vane.

* * * * *